United States Patent [19]

Michels

[11] 4,102,225

[45] Jul. 25, 1978

[54] LOW CHROMIUM OXIDATION RESISTANT AUSTENITIC STAINLESS STEEL

[75] Inventor: Harold Thomas Michels, Manhasset, N.Y.

[73] Assignee: The International Nickel Company, Inc., New York, N.Y.

[21] Appl. No.: 742,429

[22] Filed: Nov. 17, 1976

[51] Int. Cl.[2] ..... C22C 38/02; C22C 38/06

[52] U.S. Cl. ..... 75/124; 75/128 A; 75/128 C; 75/128 E; 75/128 T; 148/38

[58] Field of Search ..... 75/124, 128 A, 128 C, 75/128 E, 128 T; 148/38

[56] References Cited

U.S. PATENT DOCUMENTS

| | | | |
|---|---|---|---|
| 2,177,454 | 10/1939 | Frevert et al. | 75/128 C |
| 3,362,813 | 1/1968 | Ziolkowski | 75/124 |
| 3,729,308 | 4/1973 | Eiselstein et al. | 75/128 E |
| 3,817,747 | 6/1974 | Schultz et al. | 75/171 |
| 3,825,417 | 7/1974 | Costello | 75/128 A |
| 3,840,366 | 10/1974 | Hirayama et al. | 75/124 |

FOREIGN PATENT DOCUMENTS

| | | | |
|---|---|---|---|
| 953,947 | 9/1974 | Canada | 75/128 C |
| 953,948 | 9/1974 | Canada | 75/128 C |
| 758,009 | 9/1956 | United Kingdom | 75/128 C |
| 289,140 | 5/1969 | U.S.S.R. | 75/128 C |
| 439,542 | 2/1974 | U.S.S.R. | 75/128 C |

*Primary Examiner*—Arthur J. Steiner

*Attorney, Agent, or Firm*—R. J. Kenny; E. C. MacQueen

[57] ABSTRACT

Nickel-chromium stainless steel is of austenitic composition specially controlled to enable achieving resistance to elevated-temperature oxidation and corrosion at desirably economical levels of alloy content as low as 10% chromium and 10% nickel. Oxidation and corrosion resistant characteristics of the steel particularly include resistance to air-water atmospheres and gasoline exhaust atmospheres that are cyclically heated and cooled with heating to temperatures as high as 1800° F. and cooling to room temperature. Steel has special utility for automotive exhaust train components and is generally useful for cyclically heated structural articles.

9 Claims, No Drawings

LOW CHROMIUM OXIDATION RESISTANT AUSTENITIC STAINLESS STEEL

The present invention relates to steels and more particularly to austenitic nickel chromium steels and to products and articles thereof.

It is well known that steels of many varieties have strength and fabricability characteristics useful in manufacture of wrought products for many needs and that the plain low-carbon steels are specially good where formability and other ductility characteristics are particularly needed. It is well known that plain (unalloyed) carbon steels suffer from rusting and other corrosion and, when heated, have poor resistance to high temperature oxidation. Heretofore, the metallurgical art has displaced some of the iron in the steel with other elements in order to provide corrosion-resistant alloy steels and has achieved some very high levels of corrosion-resistance. Yet, the displacement of iron and the introduction of alloying elements has not usually been without cost inasmuch as most of the alloying elements are less plentiful and more costly than iron and, moreover, frequently show tendencies for shifting metallurgical properties toward loss of desired characteristics, e.g., loss of desired fabricability, ductility, or metallurgical stability. It has been known that low-carbon austenitic alloy steels of compositions safely within the stable austenitic ranges are generally workable and corrosion-resistant at room temperatures. Nonetheless, oxidation and other gaseous corrosion resistance at elevated temperatures around 1000° F. and higher, such as to about 1800° F., has been undesirably low and attempts to overcome this have been detracted with detriments such as low ductility, metallurgical instability, expense and/or restricted availability of alloying ingredients, e.g., chromium, or lack of desired workability, weldability or other fabricability characteristics. Presently there are still many needs still outstanding for special corrosion-resistant steels that can be made, when desired, at a lean alloy level, desirably below 15% chromium, and have good fabricability for production of devices requiring resistance to corrosion by hot corrosive gases, for instance as in combustion exhaust manifolds or mufflers.

There has now been discovered an austenitic stainless steel having specially desired characteristics of resistance to elevated temperature oxidation, including cyclic oxidation, good weldability and also formability including workability for manufacture of cold rolled strip, stress-corrosion cracking resistance and metallurgical stability for long time use throughout ranges of varying temperatures along with other characteristics needed for elevated temperature corrosion-resistant apparatus.

It is an object of the present invention to provide a corrosion-resistant steel having desirable fabricability and elevated temperature characteristics.

Another object of the invention is to provide specially oxidation-resistant wrought products.

Other objects and advantages of the invention will become apparent from the following description.

The present invention contemplates an austenitic stainless steel alloy containing (by weight) chromium in an amount of at least 10% and up to about 14% or 15%, about 10% to about 14% nickel, 2% to 7% in total of silicon-plus-aluminum in proportions of 0.5% to 4.5% silicon and 0.5% to 4.5% aluminum and sufficient to be in accord with the Cr/Si/Al relationship (A):

$$\%\,Cr+2(\%Si+\%Al)=19 \text{ to } 24$$

up to 0.7% titanium, 0.02% to 0.15% carbon, up to about 2% manganese, up to 0.05% magnesium and balance essentially iron in an amount at least about 60% of the alloy. The invention is specially beneficial for providing good resistance to cyclic elevated-temperature oxidation and corrosion, and also serviceable resistance to various other kinds of corrosion, e.g., chloride corrosion and stress-corrosion, along with good tensile strength, including stress-rupture strength, and good fabricability and metallurgical stability with a desirably lean low-chromium austenitic stainless steel wherein the chromium content can be as low as 10%.

Good characteristics can also be obtained with chromium or nickel or both at higher percentages, e.g., 16% or 18%, including alloys with 18% chromium and 18% nickel, although these larger amounts detract from the economic, and possibly strategic, benefits of restricting these elements to the 14% and lower levels. Where the composition is extended to the higher percentages, care should be observed that throughout the ranges of 10% to 18% chromium and 10% to 18% nickel, the silicon and aluminum contents are maintained according to the aforesaid proportions and the Cr/Si/Al relationship. Furthermore, where the chromium content is greater than 14%, e.g., 14.5%, it is recommended, for achieving outstanding oxidation resistance, that at least 1% aluminum be present and the following relationship (B) also be applied:

$$\%Cr+2(\%Si)+\%Al = 16 \text{ to } 23.$$

Fabricability and elevated temperature strength of the steel are benefited by the microstructure of the alloy wherein austenite is predominant at least to the extent that the face-centered-cubic crystal structure of austenite comprises 80% or more of the steel. Moreover, the steel has metallurgical stability for good retention of ductility when subjected to heat or mechanical work.

For protection of the desirable characteristics, production of the alloy steel of the invention should be particularly controlled to restrict or avoid inclusion of excessive amounts of other elements that would be detrimental to the oxidation resistance, fabricability or the stable austenitic structure. In this regard, it is to be understood that amounts of molybdenum and other ferritizing elements that would result in microstructures having less than 80% austenite would be detrimental and excessive for the composition of the present invention.

The steel may contain small amounts of deoxidizers, malleabilizers and auxiliary elements, e.g., calcium magnesium and rare earths. Phosphorus and sulfur and other impurities detrimental to steels should be maintained low according to good quality steelmaking practice.

Advantageously, for ensuring consistently good oxidation resistance, especially at lower chromium content, e.g., 12%, the composition is especially controlled to have an aluminum content of at least 2%, a silicon-plus-aluminum total of at least 3%, or more advantageously 4% or more, and a %Cr+2(%Si)+%Al total of at least 18, or, more advantageously, 18.5 or greater.

For purposes of giving those skilled in the art a better understanding of the invention, the following examples are given:

EXAMPLE I

A melt for a stainless steel containing about 12% chromium, 12% nickel, 2% aluminum, 2% silicon and 0.04% carbon (Alloy 1) was prepared by vacuum induction melting Armco iron, low-carbon ferrochrome and nickel pellets, adding about ½% titanium and subsequently melting metallic silicon and then aluminum rod into the melt. The melt was cast in iron molds for ingots and the ingots were hot rolled to ⅝-inch bars and ¼-inch thick plate. Hot workability was very good and the thus-produced wrought products of alloy 1 were of good quality. Results of chemical analysis of alloy 1 are set forth in the following Table I. Good resistance to oxidation in hot moist air and to gasoline exhaust fumes and, moreover, good mechanical properties, particularly including ductility, were confirmed by test results in tables hereinafter. Satisfactory weldability was confirmed by crack-free quality of a 5-inch length of bead layed on a ¼-inch plate of alloy 1 by the tungsten inert arc process using matching overlay filler metal.

Chemical analyses and test results pertaining to other examples are set forth in the following tables. Alloys 6, 7, 14 and 22 were air-induction melted and the others were vacuum melted. Alloys 6, 14 and 22 were hot rolled at 2050° F. to make ¼-inch plate and then alloys 6 and 14 were cold rolled to 50-mils thick by 8-inch wide sheet. Alloy 7 was air-cast in a sand mold for a 6-inch square, 12-inch deep ingot. The mold was made of sand to provide a slow rate of cooling and thus simulate the slow cooling rate of a larger cross-section ingot cooling in a metal mold. The bottom half of the sand cast ingot was cut-off, heated to 2250° F and rolled directly down to ¼-inch plate and good edge quality, without edge cracking, was obtained, thereby confirming good workability in large section sizes.

In addition to wrought product utility, the alloy can be produced in the form of stainless steel castings, in which mode the alloy will have a cast microstructure comprising dendrites of austenite dispersed in a nickel-chromium matrix.

TABLE I

| Alloy No. | Cr % | Ni % | Al % | Si % | Ti % | Mn % | C % | Mo % | Cu % | Fe % |
|---|---|---|---|---|---|---|---|---|---|---|
| 1 | 11.7 | 11.9 | 2.00 | 2.13 | 0.44 | 0.20 | 0.035 | NA | NA | Bal. |
| 2 | 10.6 | 13.7 | 2.5 | 1.9 | 0.40 | 0.22 | 0.086 | 0.21 | .22 | Bal. |
| 3 | 10.3 | 13.8 | 2.5 | 2.9 | 0.4 | 0.25 | 0.060 | 0.20 | .22 | Bal. |
| 4 | 10.5 | 13.8 | 3.9 | 1.9 | 0.41 | 0.22 | 0.010 | 0.21 | .22 | Bal. |
| 5 | 10.7 | 13.9 | 2.5 | 4.0 | 0.38 | 0.24 | 0.068 | 0.20 | .23 | Bal. |
| 6 | 11.1 | 12.4 | 2.60 | 1.98 | 0.48 | 0.28 | 0.039 | NA | NA | Bal. |
| 7 | 11.8 | 11.9 | 1.80 | 1.90 | 0.17 | 0.26 | 0.037 | 0.20 | .20 | Bal. |
| 8 | 12.2 | 10.1 | 1.0 | 2.9 | 0.42 | 0.23 | 0.077 | 0.21 | .21 | Bal. |
| 9 | 12.2 | 10.3 | 2.0 | 1.8 | 0.43 | 0.20 | 0.072 | 0.21 | .22 | Bal. |
| 10 | 11.9 | 12.0 | 1.00 | 3.00 | 0.50 | 0.19 | 0.036 | 0.21 | .19 | Bal. |
| 11 | 12.0 | 11.6 | 2.01 | 1.90 | 0.42 | 0.15 | 0.040 | 0.20 | .18 | Bal. |
| 12 | 12.1 | 12.2 | 2.07 | 1.99 | 0.46 | 0.18 | 0.038 | 0.21 | .19 | Bal. |
| 13 | 12.0 | 12.1 | 2.02 | 2.99 | 0.40 | 0.18 | 0.040 | 0.21 | .21 | Bal. |
| 14 | 12.3 | 12.2 | 2.44 | 1.91 | 0.36 | 0.26 | 0.071 | NA | NA | Bal. |
| 15 | 12.0 | 11.9 | 3.09 | 0.96 | 0.43 | 0.19 | 0.040 | 0.20 | .19 | Bal. |
| 16 | 12.8 | 13.6 | 2.0 | 1.9 | 0.37 | 0.23 | 1.12 | 0.21 | .22 | Bal. |
| 17 | 12.7 | 13.8 | 2.1 | 2.8 | 0.40 | 0.21 | 0.14 | 0.22 | .24 | Bal. |
| 18 | 12.7 | 13.6 | 3.0 | 1.0 | 0.41 | 0.22 | 0.096 | 0.22 | .24 | Bal. |
| 19 | 12.7 | 13.7 | 3.1 | 2.0 | 0.41 | 0.23 | 0.088 | 0.22 | .23 | Bal. |
| 20 | 13.2 | 11.3 | 1.1 | 4.0 | 0.39 | 0.23 | 0.090 | 0.21 | .23 | Bal. |
| 21 | 13.1 | 11.3 | 2.70 | 1.98 | 0.47 | 0.24 | 0.035 | 0.23 | .24 | Bal. |
| 22 | 14.3 | 10.0 | 1.1 | 1.8 | 0.39 | 0.24 | 0.067 | 0.21 | .20 | Bal. |
| 23 | 14.3 | 10.0 | 1.2 | 3.0 | 0.42 | 0.24 | 0.054 | 0.21 | .21 | Bal. |
| 24 | 14.4 | 9.9 | 2.6 | 0.76 | 0.42 | 0.21 | 0.048 | 0.21 | .20 | Bal. |
| 25 | 14.0 | 14.0 | 1.0 | 3.7 | 0.39 | 0.22 | 0.14 | 0.21 | .23 | Bal. |
| 26 | 14.0 | 14.1 | 1.9 | 2.9 | 0.38 | 0.22 | 0.18 | 0.2 | .23 | Bal. |
| 27 | 14.6 | 13.8 | 2.0 | 1.9 | 0.38 | 0.24 | 0.090 | 0.20 | .21 | Bal. |
| 28 | 14.6 | 14.0 | 3.1 | 1.0 | 0.38 | 0.22 | 0.076 | 0.20 | .22 | Bal. |
| 29 | 17.1 | 17.2 | 2.31 | 1.03 | 0.43 | 0.32 | 0.049 | 0.20 | .23 | Bal. |

NA — Not Added & Not Analyzed

Cyclic oxidation results on steel specimens of compositions referred to in Table I are set forth in the following Table II. Prior to oxidation, specimens were solution treated at 1900° F. for one hour, wet ground to size (about ¾ × 1 × ⅛-inch) with a 20 microinch surface finish. The cyclic oxidation was in a 3.5-inch diameter tube furnace with an atmosphere of air plus 10 vol. % water vapor flowing at 0.3 m/min (11.8 inch/min). The specimens, held in a platinum rack, were maintained at the oxidation temperature for 2-hour exposure periods, then removed and cooled to room temperature, and repeatedly returned to the furnace to provide the cyclic effect. Specimens were weighed after every third cycle (6 hours) during the total exposure of 102 hours. The results show, among other things, very good oxidation resistance obtained with the alloys containing 2% or more, e.g., 2.1% or 4%, silicon, for instance, Alloy No. 1.

TABLE II

| Alloy No. | ΔW-U | ΔW-D | Alloy No. | ΔW-U | ΔW-D |
|---|---|---|---|---|---|
| 1500° F. Exposure | | | | | |
| 6 | + 0.15 | − 0.22 | 14 | + 0.15 | − 0.44 |
| 7 | + 0.16 | − 0.45 | 22 | + 0.14 | − 0.36 |
| 1800° F. Exposure | | | | | |
| 1 | − 0.37 | − 4.2 | 19 | − 6.4 | − 8.8 |
| 2 | − 7.3 | − 10.1 | 20 | + 0.50 | − 2.0 |
| 3 | + 1.2 | − 1.7 | 21 | − 0.28 | − 2.6 |
| 4 | − 1.1 | − 3.0 | 22 | − 14.8 | − 18.6 |
| 5 | + 1.2 | − 1.0 | 23 | + 1.3 | − 1.5 |
| 8 | + 0.95 | − 1.7 | 24 | − 6.4 | − 10.2 |
| 9 | − 17.4 | − 20.7 | 25 | − 0.32 | − 2.6 |
| 11 | + 0.55 | − 2.6 | 26 | − 0.01 | − 2.1 |
| 16 | − 23.0 | − 26.9 | 27 | − 12.5 | − 16.5 |
| 17 | − 0.04 | − 2.2 | 28 | + 0.97 | − 1.5 |
| 18 | − 9.9 | − 15.5 | 29 | + 0.64 | − 2.7 |

ΔW-U = Weight Change, Undescaled, in milligrams per square centimeter
ΔW-D = Weight Change, Descaled in milligrams per square centimter Hot corrosion resistance during cyclic exposure to gasoline combustion products in internal combustion engine exhaust fumes is exemplified with corrosion test results set forth in Table III. The exhaust gas environment was produced with a 2500 watt ONAN electric generating plant and analytically monitored. The gas composition was controlled with respect to carbon monoxide (CO) and oxygen ($O_2$) while the levels of unburned hydrocarbons (HC) and oxides of nitrogen ($NO_x$) were not. CO was maintained at 2.0±0.2% by adjusting the carburetor fuel mixture and $O_2$ was maintained at 0.5±0.02% by adding $O_2$ to the exhaust stream. $NO_x$ was estimated to be in the range of 0.10±0.02%. Over the normal "tight emissions" life of the engine (150–250 hours), $O_2$ and HC levels at the engine exhaust port increased from 0.25 to 0.50% and 0.05 to 0.25%, respectively. As either of these upper values was reached, the engine was overhauled. Operating the engine under these conditions is considered to give a reasonable simulation of an automobile exhaust environment.

The corrosion specimens, about ⅛ × 1 × 1.5-inch, 20 microinch finish, were exposed in a 2.5-inch I.D. three-zone tube furnace through which the exhaust gas was passed at a velocity of 6–9 m/s (20–30 ft/sec). Time at temperature for each cycle was 6 hours, after which the specimens were weighed. The location of each specimen in the rack was varied in a systematic manner after each cycle to minimize position effects due to possible variation in gas composition, gas velocity, or temperature within the test zone.

TABLE III

| Alloy No. | Test Temp. | Total Time | Weight Change (mg/cm²) ΔW-U | ΔW-D | Metal Damage (Microns) ML | Dia. |
|---|---|---|---|---|---|---|
| 21 | 1500° F. | 102Hr | +0.61 | −2.4 | <25 | <25 |
| 21 | 1800° F. | 102Hr | −48 | −92 | 56 | 127 |
| 29 | 1500° F. | 102Hr | +0.42 | −0.03 | <25 | <25 |
| 29 | 1800° F. | 102Hr | −15 | −20 | 29 | 43 |

ΔW-U+Weight Change, Undescaled, in milligrams per square centimeter
ΔW-D=Weight Change, Descaled in milligrams per square centimeter
ML=Metal Loss
DIA=Depth of Internal Attack For comparison, Schedule A below shows chemical analyses and test results obtained by applying the same testing procedures to other steels that were obtained from commercial sources and differ from the present invention, and are referred to herein as steels 304, 309 and 310. It should be noted that they all contain a greater percentage of chromium than those of the present invention.

Schedule A

| Steel | Cr % | Ni % | Al % | Si % | Ti % | Mn % | C % | Specimen Thickness (cm) |
|---|---|---|---|---|---|---|---|---|
| 304 | 19 | 10 | <0.1 | 0.52 | <0.1 | 1.5 | 0.05 | 0.122 |
| 309 | 23 | 15 | <0.1 | 0.45 | <0.1 | 1.9 | 0.05 | 0.135 |
| 310 | 25 | 22 | <0.1 | 0.54 | 0.26 | 1.8 | 0.05 | 0.135 |

| | Cyclic Oxidation at 1500° F. ΔW-U | ΔW-D | Cyclic Exhaust at 1500° F. ΔW-U | ΔW-D |
|---|---|---|---|---|
| 304 | +0.17 | −0.09 | −165(a) | −196(a) |
| 309 | +0.27 | −0.21 | −73 | −81 |
| 310 | +0.31 | −0.15 | −49 | −57 |

| | Cyclic Oxidation at 1800° F. ΔW-U | ΔW-D | Cyclic Exhaust at 1800° F. ΔW-U | ΔW-D |
|---|---|---|---|---|
| 304 | −340 | −352 | −26(b) | −489(b) |
| 309 | −12 | −19 | −104 | −108 |
| 310 | +1.0 | −3.2 | − 81 | − 87 |
| | +0.92 | −4.1 | − 40 | − 48 |

(a)Specimen removed from test at 60 hrs. due to extensive attack
(b)Specimen removed from test at 18 hrs. due to extensive attack Room temperature tensile characteristics of 0.2% offset yield strength (YS) and ultimate tensile strength (UTS) in kips per square inch (ksi) and of percentage elongation (Elong.) and percent reduction of cross-sectional area (RA) measured in short-time tensile testing ¼-inch diameter, 1¼-inch gage length, specimens of annealed and of anneal-plus-aged wrought products having chemical analyses referred to in Table I are set forth in the following Table IV, which also shows properties of two cold-worked specimens of alloy 11. It is noteworthy that the cold worked alloy showed good retention of ductility and freedom from embrittlement after sustaining a 1000 pound per square inch load for 1000 hours at 1300° F.

Stress-rupture results, tested with ¼-inch diameter, 1-inch gage length, specimens of annealed wrought products are set forth in Table V.

TABLE IV

| Alloy No. | Prior Treatments (with Air Cool) | YS (ksi) | UTS (ksi) | Elong. (%) | RA (%) |
|---|---|---|---|---|---|
| 1 | 1900° F/1Hr | 45.7 | 123.0 | 34 | 72 |
| | 1900° F/hHr+1300° F/16Hr | 55.4 | 145.2 | 24 | 59 |
| | 1900° F/1Hr+1500° F/16Hr | 59.0 | 135.5 | 25 | 66.5 |
| 7 | 1900° F/Hr | 29.7 | 105.6 | 48 | 74 |
| | 2100° F/1Hr | 22.5 | 105.2 | 45 | 74 |
| 10 | 1900° F/1Hr | 36.4 | 107.7 | 50 | 76 |
| | 2100° F/1Hr | 29.4 | 104.1 | 57 | 75 |
| 11 | 1900° F/1Hr | 35.6 | 109.2 | 43 | 75 |
| | 1900° F/1Hr+ 900° F/ 1Hr | 37.6 | 111.7 | 42 | 69 |
| | 1900° F/1Hr+ 900° F/ 10Hr | 37.3 | 111.0 | 43 | 57 |
| | 1900° F/1hr+ 900° F/100Hr | 40.6 | 113.0 | 43 | 67 |
| | 1900° F/1Hr+1100° F/ 1Hr | 36.9 | 108.2 | 45 | 75 |
| | 1900° F/1Hr+1100° F/ 1OHr | 38.4 | 108.9 | 44 | 73 |
| | 1900° F/1Hr+1100° F/100Hr | 51.4 | 125.1 | 34 | 69 |
| | 1900° F/1Hr+1300° F/ 1Hr | 45.1 | 113.8 | 38 | 72 |
| | 1900° F/1Hr+1300° F/ 10Hr | 53.8 | 122.0 | 31 | 70 |
| | 1900° F/1Hr+1300° F/100Hr | 61.8 | 133.9 | 28 | 68 |
| | 1900° F/1Hr+1500° F/ 1Hr | 54.4 | 116.5 | 33 | 73 |
| | 1900° F/1Hr+1500° F/ 10Hr | 59.9 | 119.9 | 31 | 71 |
| | 1900° F/1Hr+1500° F/100Hr | 68.4 | 129.2 | 28 | 67 |
| | 1900° F/1Hr+1500° F/250Hr | 51.9 | 119.1 | 34 | 72 |
| | 2100° F/1Hr | 29.2 | 106.0 | 50 | 77 |
| | 10% Cold Work+1300° F/ 1000Hr | 117.7 | 168.6 | 16 | 53 |
| | 10% Cold Work+1300° F/ 1000Hr. at lksi | 112.0 | 162.2 | 16 | 53 |
| 12 | 1900° F/1Hr | 40.8 | 107.8 | 46 | 76 |
| | 2100°F/1Hr | 28.7 | 108.3 | 47 | 76 |
| 13 | 1900° F/1Hr | 40.5 | 112.5 | 54 | 74 |
| | 2100° F/1Hr | 37.0 | 116.4 | 54 | 70 |
| 15 | 1900° F/1Hr | 43.9 | 121.0 | 36 | 69 |
| | 2100° F/1Hr | 31.0 | 120.0 | 36 | 68 |
| 29 | 1900° F/1Hr | 35.1 | 90.6 | 46.0 | 71.5 |
| | 2100° F/1Hr | 28.3 | 84.6 | 52.0 | 70.0 |

TABLE V

| Al-loy No. | Heat Treatment (with Air Cool) | Test Temp. | Stress (ksi) | Life (Hr) | Elong. (%) | RA (%) |
|---|---|---|---|---|---|---|
| | 1900° F/1Hr | 1500° F. | 6.0 | 117.2 | 41 | 52 |
| | 1900° F/1Hr | 1500° F. | 5.0 | 602.6 | 43 | 40 |

TABLE V-continued

| Alloy No. | Heat Treatment (with Air Cool) | Test Temp. | Stress (ksi) | Life (Hr) | Elong. (%) | RA (%) |
|---|---|---|---|---|---|---|
| | 1900° F/1Hr | 1500° F. | 4.0 | 1837.5 | 35 | 31 |
| | 2100° F/1Hr | 1500° F. | 9.0 | 51.0 | 49 | 46 |
| | 2100° F/1Hr | 1500° F. | 8.0 | 78.2 | 33 | 37 |
| | 2100° F/1Hr | 1500° F. | 7.0 | 287.2 | 30 | 32 |
| | 2100° F/1Hr | 1500° F. | 6.0 | 270.7 | 22 | 26 |
| | 2100° F/1Hr | 1500° F. | 5.0 | 923.0 | 18 | 30 |
| | 2100° F/1Hr | 1500° F. | 6.0 | 2560.9 | 32 | 18 |
| | 1900° F/1Hr +2100° F/1Hr | 1800° F. | 3.0 | 45.3 | 130 | 92 |
| 10 | 2100° F/1Hr | 1500° F. | 8.0 | 61.1 | 77 | 90 |
| | 2100° F/1Hr | 1500° F. | 6.0 | 740.0 | 110 | 84 |
| | 2100° F/1Hr | 1800° F. | 3.0 | 38.7 | 85 | 96 |
| 11 | 1900° F/1Hr | 1500° F. | 7.0 | 138.0 | 101 | 76 |
| | 1900° F/1Hr | 1500° F. | 5.0 | 523.2 | 72 | 70 |
| | 2100° F/1Hr | 1500° F. | 10.0 | 28.8 | 98 | 80 |
| | 2100° F/1Hr | 1500° F. | 9.0 | 86.4 | 64 | 55 |
| | 2100° F/1Hr | 1500° F. | 8.0 | 102.1 | 73 | 63 |
| | 2100° F/1Hr | 1500° F. | 7.0 | 240.7 | 50 | 47 |
| | 2100° F/1Hr | 1500° F. | 6.0 | 485.0 | 58 | 55 |
| | 2100° F/1Hr | 1500° F. | 5.0 | 1142.8 | 35 | 38 |
| | 2100° F/1Hr | 1800° F. | 3.0 | 62.5 | 54 | 63 |
| 12 | 2100° F/1Hr | 1500° F. | 8.0 | 72.0 | 65 | 62 |
| | 2100° F/1Hr | 1500° F. | 6.0 | 1121.0 | 51 | 49 |
| | 2100° F/1Hr | 1800° F. | 3.0 | 38.5 | 101 | 96 |
| 21 | 2100° F/1Hr | 1500° F. | 9.0 | 12.0 | 63 | 75 |
| | 2100° F/1Hr | 1500° F. | 6.0 | 48.0 | 75 | 79 |
| | 2100° F/1Hr | 1800° F. | 3.0 | 10.0 | 137 | 89 |

Resistance to rusting and pitting of the alloy at the 12% chromium level was confirmed by CASS testing (in an aqueous NaCl, $CuCl_2$, acetic acid environment) a specimen of alloy No. 11 for two 24-hour periods. The CASS test results showed the invention succeeded in providing rust resistant and pitting resistant characteristics equal to those of control test specimens of Type 316 stainless steel.

Stress-corrosion-cracking resistance is another attribute of the alloy of the invention that was confirmed by testing. U-bend specimens of alloy No. 1 survived immersions of 90 days and longer in the boiling (309° F.) magnesium chloride test and in the boiling saturated sodium chloride (aqueous solution) test without observable cracking. Moreover, U-bend specimens having a weld at the U-bend apex did not crack after 90 days in the 196° F., 3½% sodium chloride vapor test.

Satisfactory weldability was confirmed with crack-free results in 6-inch bead lengths obtained when autogenous inert-gas shielded tungsten-arc(TIG)beads were run automatically down the 6-inch surfaces of surface-ground ¼-inch thick plates of 19 of the steels, namely, alloys 1-4, 7-13, and 15 to 21.

The present invention is particularly applicable in providing wrought products, e.g., sheet, plate, strip, tubing, bar, wire, mesh and the like for production of articles to be used in contact with hot corrosive gas, particularly including automotive combustion-exhaust train components, e.g., manifolds, conduits, thermal reactors, catalyst containers, and mufflers. The invention is generally applicable in providing structural components, e.g., supports, braces, baffles, brackets and heat shields and also bolts, rivets and other fasteners.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. An austenitic nickel-chromium stainless steel alloy consisting essentially of 10% to 15% chromium, about 10% to about 18% nickel, 0.5% to 4.5% silicon and 0.5% to 4.5% aluminum in amounts providing a total silicon-plus-aluminum content of 2% to 7% and correlated with the chromium content to provide that $$\%\ Cr+2(\%Si+\%Al) = 19 \text{ to } 24,$$

0.02% to 0.15% carbon, up to 0.7% titanium, up to 2% manganese, up to 0.05% magnesium and balance essentially iron in an amount at least 60% of the alloy.

2. An alloy as set forth in claim 1 wherein the aluminum content is at least 2%, the silicon-plus-aluminum content is at least 3% and wherein the amounts of chromium, silicon and aluminum are in accordance with the relationship $$\%\ Cr+2(\%Si)+\%Al \text{ equal at least } 18.$$

3. An alloy as set forth in claim 1 wherein the chromium content is greater than 14%, the aluminum content is at least 1% and wherein the amounts of chromium, silicon and aluminum are in accordance with the relationship $$\%\ Cr+2(\%Si)+\%Al = 16 \text{ to } 23.$$

4. An alloy as set forth in claim 1 containing 10% to about 14% chromium and about 10% to about 14% nickel.

5. An alloy as set forth in claim 1 containing about 12% chromium, about 12% nickel, 2% to 2.5% silicon and about 2% aluminum.

6. A stainless steel wrought product made of the alloy set forth in claim 1 and having a worked microstructure wherein at least 80% of the structure is austenite.

7. A stainless steel product as set forth in claim 6 including in the form of a cold-work sheet, strip, bar or wire.

8. An austenitic stainless steel casting of the composition set forth in claim 1 and having a cast microstructure comprising as-cast dendrites of austenite dispersed in a nickel-chromium matrix.

9. An automotive exhaust train component made of the alloy set forth in claim 1.

* * * * *